US005779247A

United States Patent [19]

Anselmo

[11] Patent Number: 5,779,247

[45] Date of Patent: Jul. 14, 1998

[54] WHEELED ALL TERRAIN RECREATIONAL DEVICE

[76] Inventor: Anthony Gray Anselmo, 177 Main St., Harwich, Mass. 02645

[21] Appl. No.: 642,695

[22] Filed: May 3, 1996

[51] Int. Cl.[6] ..... A63C 17/08

[52] U.S. Cl. ..... 280/11.24; 280/78

[58] Field of Search ..... 280/11.24, 843, 280/11.26, 78, 11.36, 11.27; D21/224, 226

[56] References Cited

U.S. PATENT DOCUMENTS

| | | | |
|---|---|---|---|
| 92,936 | 7/1869 | Brownlee | 280/11.24 |
| D. 244,706 | 6/1977 | Vela | D34/15 |
| 1,023,882 | 4/1912 | Schiesari | 280/11.24 |
| 2,520,793 | 8/1950 | Blackwell | 280/11.24 |
| 2,675,243 | 4/1954 | King | 280/11.24 |
| 2,931,012 | 3/1960 | Kosach . | |
| 3,663,031 | 5/1972 | Young | 280/11.24 |
| 4,310,168 | 1/1982 | Macaluso | 280/11.24 |
| 4,363,493 | 12/1982 | Veneklasen | 280/11.2 |
| 4,709,937 | 12/1987 | Lin et al. | 280/11.2 |
| 4,943,073 | 7/1990 | Wander | 280/47.27 |
| 4,943,075 | 7/1990 | Gates | 280/842 |
| 4,991,861 | 2/1991 | Carn et al. | 282/87.042 |
| 5,092,614 | 3/1992 | Malewicz | 280/11.22 |
| 5,106,110 | 4/1992 | Williamson | 280/11.2 |
| 5,160,155 | 11/1992 | Barachet | 280/87.042 |
| 5,193,827 | 3/1993 | Olson | 280/7.13 |
| 5,312,120 | 5/1994 | Wiegner | 280/11.2 |
| 5,390,958 | 2/1995 | Soo | 280/844 |
| 5,411,277 | 5/1995 | Pratt | 280/11.22 |
| 5,437,466 | 8/1995 | Meibock et al. | 280/11.22 |

FOREIGN PATENT DOCUMENTS

| | | | |
|---|---|---|---|
| 112763 | 11/1928 | Austria | 280/11.24 |
| 373580 | 5/1907 | France | 280/11.24 |
| 812803 | 5/1937 | France | 280/11.24 |
| 67606 | 4/1914 | Switzerland | 280/11.24 |
| 108952 | 6/1925 | Switzerland | 280/11.24 |

*Primary Examiner*—Brian L. Johnson
*Assistant Examiner*—Bridget Avery
*Attorney, Agent, or Firm*—Steven N. Fox, Esq.

[57] ABSTRACT

A recreational device for use by a person to traverse a terrain surface. In one embodiment, the device comprises a wheel member and a track member engaged thereto. The track member comprises first and second bearing surfaces. The device further comprises a foot plate member adapted to carry and support the person. The device further comprises first and second bearing members extending from the foot plate member and engaged with the first and second bearing surface, respectively. In operation, as the wheel member traverses a terrain, the track member is caused to rotate within the first and second bearing members and about the foot plate member.

17 Claims, 5 Drawing Sheets

WHEELED ALL TERRAIN RECREATIONAL DEVICE

FIELD OF THE INVENTION

The present invention relates to recreational devices. More specifically, the present invention relates to recreational devices which can be used by persons to traverse variety of terrain surfaces such as mountain trails.

BACKGROUND OF THE INVENTION

During the winter months, ski resorts are filled to capacity with people who ski down the mountain trails. However, during the summer months the mountain trails are barely used. In some limited cases, ski resorts have adapted the mountain trails to allow the use of mountain bikes to traverse the mountain trails.

One object of the present invention is to provide a recreational device which can be used by people to traverse a variety of terrain surfaces such as mountain trails.

SUMMARY OF THE PRESENT INVENTION

The present invention is a recreational device which can be used by a person to traverse a terrain such as mountain trail. In one embodiment, the device comprises a wheel member and a track member engaged with the wheel member. The track member comprises a first bearing surface and a second bearing surface. The device further comprises a foot plate member adapted to carry and support the foot of the person. The device further comprises first and second bearing members mounted to the foot plate member such that the first bearing member is engaged with the first bearing surface and the second bearing member is engaged with the second bearing surface. In operation, as the wheel member traverses a terrain, the track member is caused to rotate within the first and second bearing members and about the foot plate member.

BRIEF DESCRIPTION OF THE DRAWINGS

The following detailed description of the invention will be better understood with reference to the accompanying drawings in which.

DETAILED DESCRIPTION OF THE PREFERRED EMBODIMENTS

Figure 1:
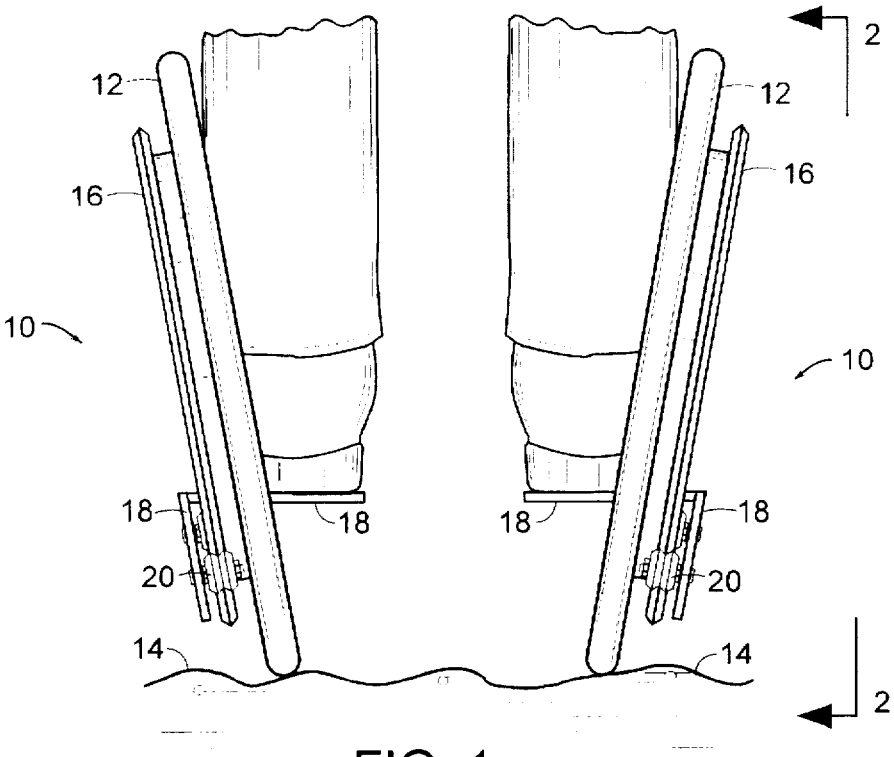
FIG. 1 is a rear perspective view of a first embodiment of the present invention.
Figure 2:
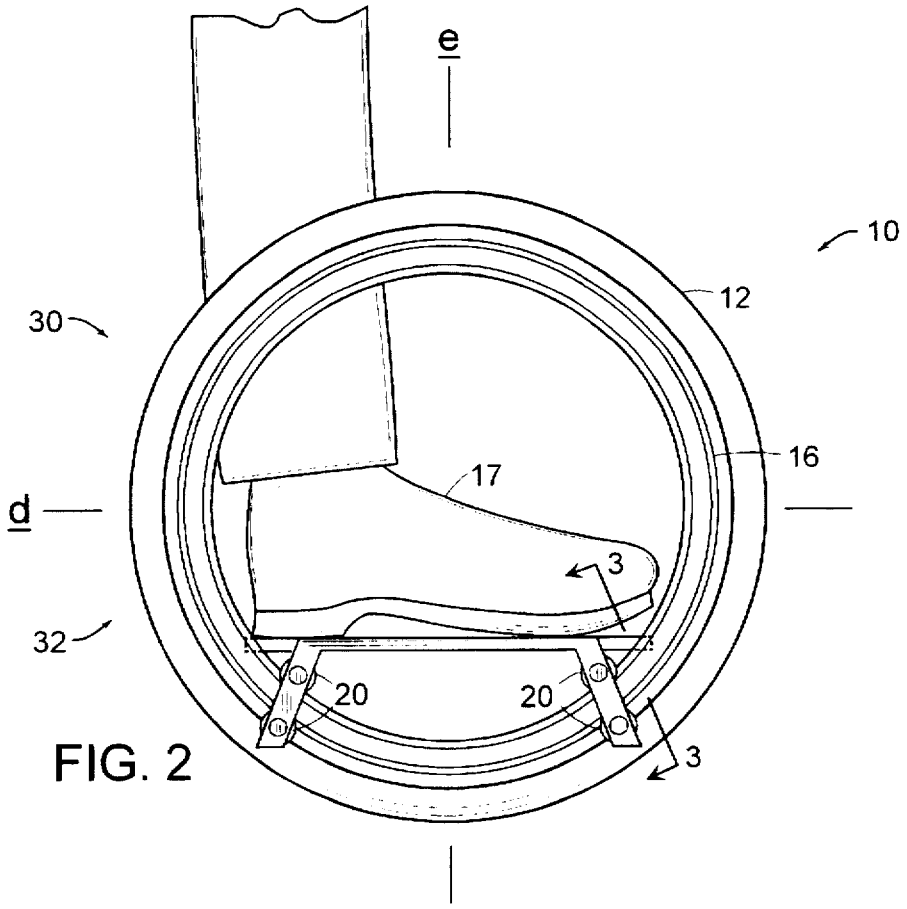
FIG. 2 is a side perspective view of the first embodiment of the present invention.

Referring to FIGS. 1–2, wherein a first embodiment of a recreational device 10 of the present invention is shown. The device 10 generally comprises a wheel member 12 adapted to engage with or roll upon a surface 14, and a track member 16. The device 10 further comprises a foot plate member 18 and a plurality of bearing members 20 which are mounted to the foot plate member 18 and which are engaged with the track member 16 to thereby allow the track member 16 to rotate within the bearing members 20. The foot plate member 18 is generally adapted to receive and support the foot 17 of the person of the device 10. In operation, as the wheel member 12 is traversed (rolled) upon a surface, the track member 16 is caused to rotate within the bearing members 20 and the foot plate member 18 is held stationary along with the feet 17 of the person.

Figure 3:
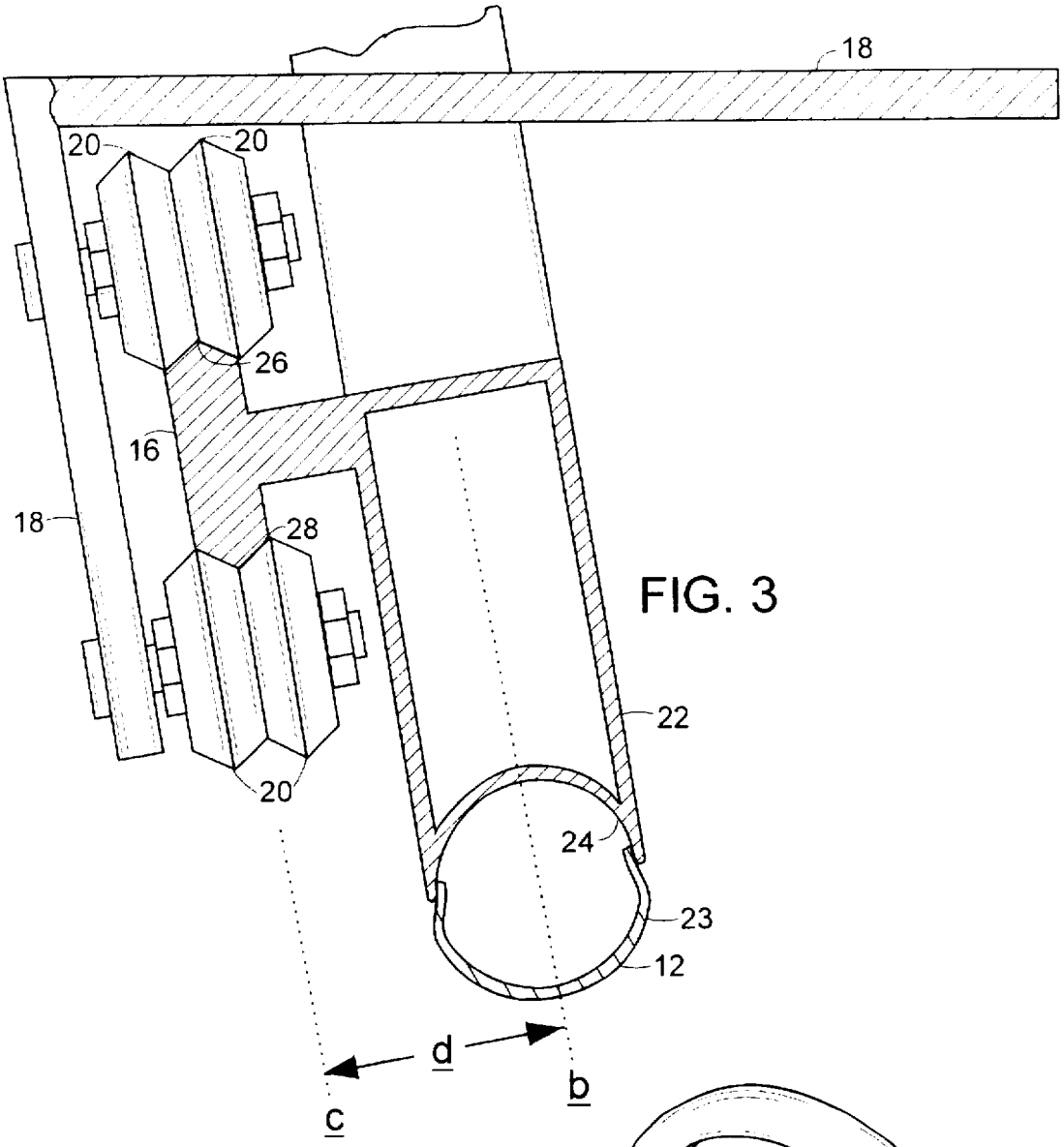
FIG. 3 is a cross-section view taken along line 3—3 of FIG. 2.
Figure 4:
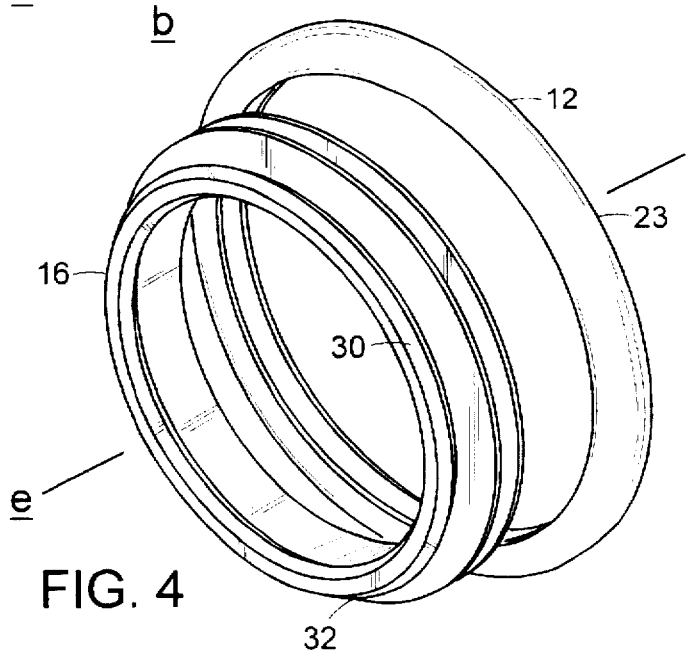
FIG. 4 is a perspective view of the wheel and track member.
Figure 5:
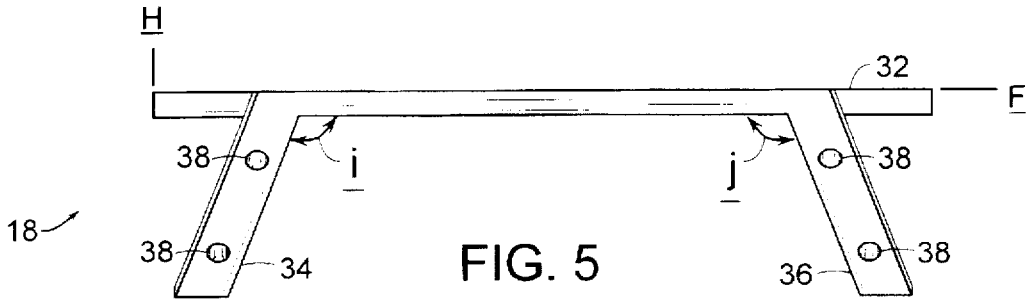
FIG. 5 is a end plan view of the foot plate member.
Figure 6:
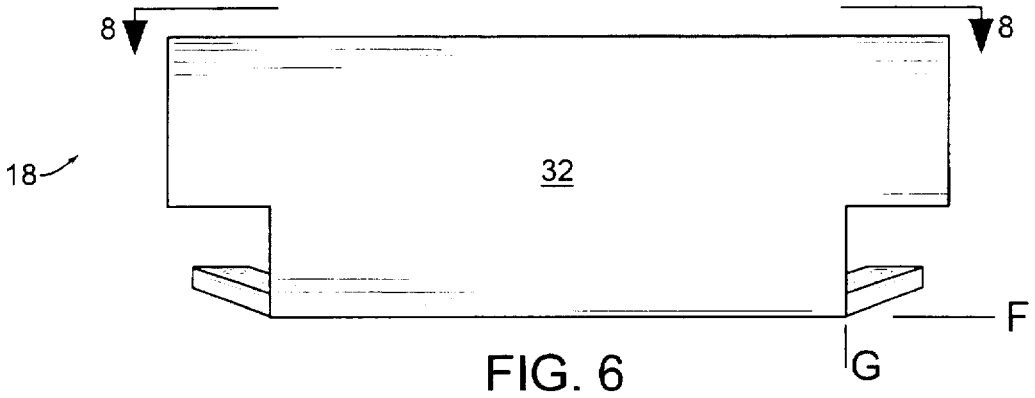
FIG. 6 is a top plan view of the foot plate member.
Figure 7:
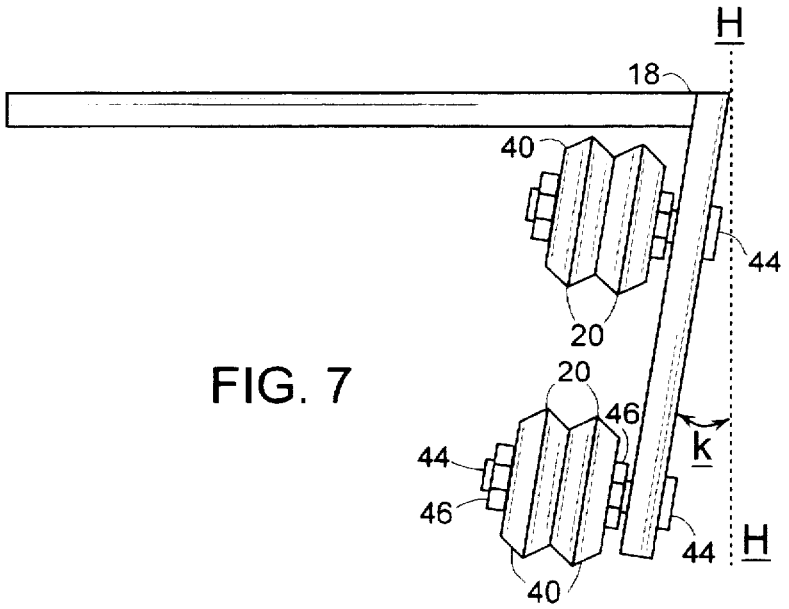
FIG. 7 is a side view of the bearing members/foot plate member sub-assembly.
Figure 8:
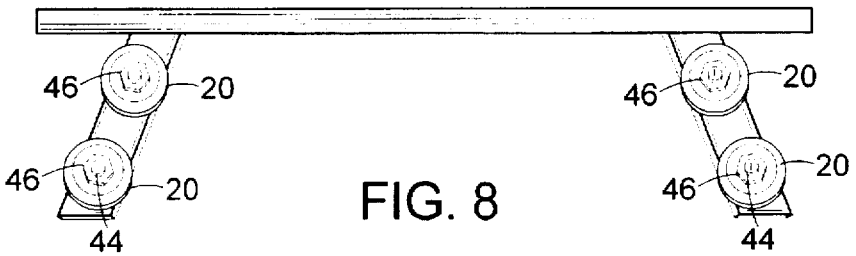
FIG. 8 is a front view of the bearing members/foot plate member sub-assembly.

Referring to FIGS. 3 and 4, wherein the wheel member 12 and track member 16 are shown in detail. The wheel member 12 generally comprises a housing or frame 22 and a tire 23. The housing 22 comprises a generally semi-cylindrical and annular channel 24 defined by a center-line or axis b and is adapted to receive the tire 23. The tire 23 and the housing 22 are shown as separate components. Alternatively, the tire 23 and the housing 22 may be integrally formed, by for example, a molding process.

The track member 16 generally comprises a first bearing surface 26 and a second bearing surface 28. The first bearing surface 26 and second bearing surface 28 are of continuous annular shape and are adapted to engage with one or more of the bearing members 20. As will be described more fully herein, the bearing members 20 may be engaged with the first bearing surface 26 and the second bearing surface in a variety of ways. The first bearing surface 26 and the second bearing surface 28 are opposite to each other in substantially alignment. The center of the track member 16 and first and second bearing surfaces 26 and 28 is defined by a center-line c . In the embodiment shown, the track member 16 is positioned adjacent to and substantially parallel to the wheel member 12. The track member 16 is also shown spaced a distance d from the wheel member 12.In the embodiment shown, the track member 16 is preferably of solid hollow construction and is integrally formed with the housing 22.The preferred distance c is about one (1.0) inch although distance c may be of greater or lesser dimensions. The axial center of the wheel member 12 and the track member 16 is defined by an axis e about which the wheel member 12 and track member 16 rotate. The track member 16 is further defined by an upper half portion 30 and a lower half portion 32. In the embodiment shown, two bearing members 20, spaced a distance from each other, are engaged with the first bearing surface 26 and two additional bearing members are engaged with the second bearing surface 28. In the embodiment shown, the bearing members 20 on the first bearing surface are in a position substantially opposite to the engagement of the bearing members 40 engaged with the second bearing surface 28. As such, the track member 16 can securely rotate within and about the four bearing members 20 while maintaining the foot plate member 18 in a fixed or stationary position.

Referring to FIGS. 5–8, wherein the foot plate members 18 and the four bearing members 20 are shown. The foot plate member 18 generally comprises a substantially planar support plate 32 defined by horizontal planes f and g and a vertical plane h. The foot plate member 18 further comprises legs or flanges 34 and 36 connected integrally to and extending from the support plate 32 and positioned at an angle i relative to vertical plane f and at angle k relative to vertical plane axis h. In the embodiment shown, angle i is about forty-five (45) degrees while angle k is about ten (10) degrees. Each of legs 34 and 36 have two mounting holes or openings 38 adapted to securely engage with one of the bearing members 20.

In the embodiment shown, each of the bearing members 20 comprises two separate bearing elements or components 40 which are attached to the foot plate member through opening 38 by a bolt 44 and nuts 46. Bearing members 20 and track member 16 may take a variety of different forms and designs so long as the bearing members 20 and track 18 can engage with each other so that the track member 16 can securely rotate within and about the four bearing members 20 while maintaining the foot plate member 18 in a stationary position. In the embodiment shown, bearing members 20 are known as journal bearings and are available from Bishop-Wisecarver Corporation, 2104 Martin Way, Pittsburgh, Calif. 94565. Model number RSJ/BHJ-34. By way of example, the bearing members 20 may take the form of a "Dual L Vee" bearing which is also vailable from Bishop-Wisecarver Corporation. In the case of a "Dual L Vee" bearing, bearing member 20 would not be formed of two separate bearing elements 40 but would comprise a single bearing assembly which could be directly attached to the track member 16. However, regardless of the design of bearing member 20, the track 18 must be compatiable therein so that track member 16 can securely rotate within and about the bearing members 20 while maintaining the foot plate member 18 in a stationary position.

Figure 9:
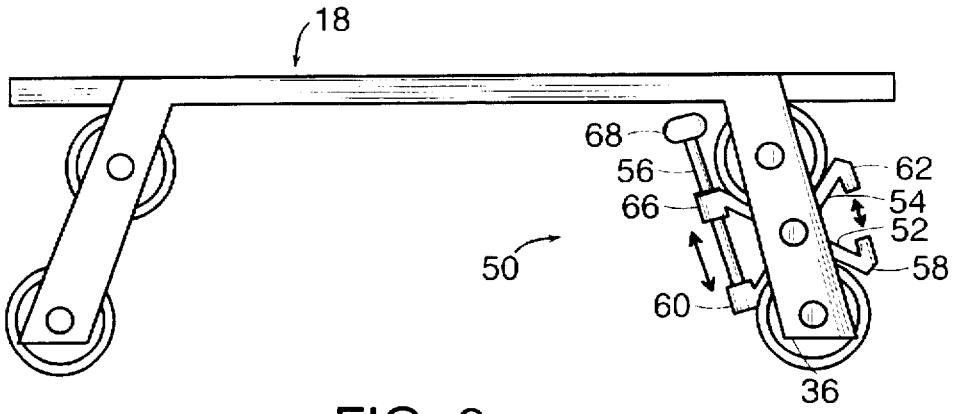
FIG. 9 is a side view of a first embodiment of a brake system mounted to the foot plate member.
Figure 10:
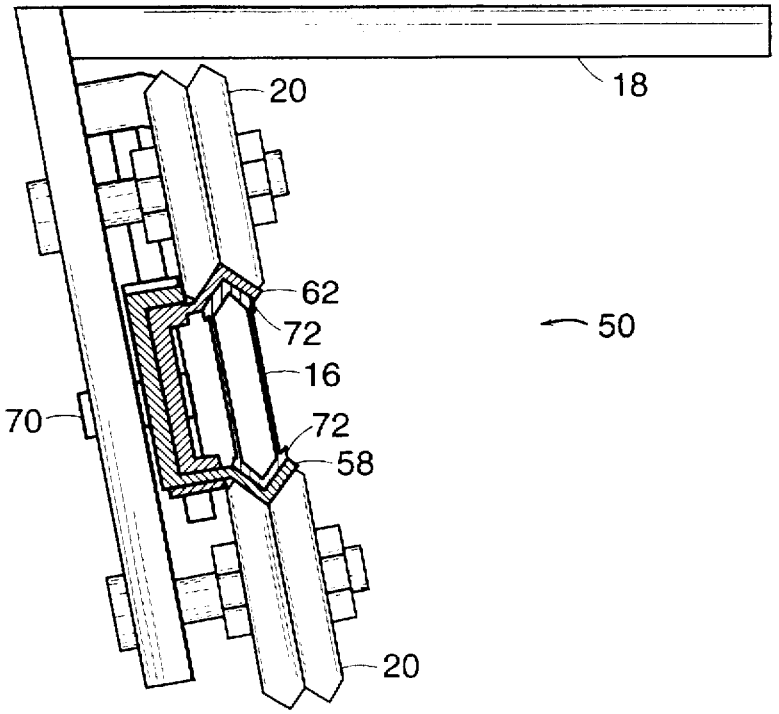
FIG. 10 is a front cross-section view of the first embodiment of the brake system shown mounted to the foot plate member.

Referring to FIG. 9–10, wherein the device 10 is shown further comprising a brake system 50. The brake system 50 is generally adapted to allow the person to slow the velocity or speed at which the track member 18 can rotate within and about the bearing members 20. The brake system 50 is further adapted to clean the track member 18 as the track member 18 rotates within the bearing members 20.

In the embodiment shown, the brake system 50 generally comprises a first support member 52 and a second support member 54 rotatably mounted to leg 36 about a bolt 70. One end of the first support member 52 comprises a mounting lug 56 and a the other end comprises a brake member or pad 58. The second support member 54 comprises a first end having a lug 60 and a second end having a brake member or pad 62. The brake 50 further comprises a threaded bolt 66 having a knob or handle 68 and a annular plate member 72 secured to a median portion of the bolt 66. The brake pads 58 and 62 are formed such that they can substantially engage with the track member 18 to apply friction or opposition to the rotation of the track member 18. In the embodiment shown, the first and second bearing surfaces 26 and 28 of the track member 18 are of V-shape and as such, the brake pads 58 and 62 are of similar shape. In operation, when bolt 66 is rotated in one direction, the lugs 56 and 60 are caused to move toward each other thereby causing the brake pads 58 and 62 to move inward and apply contact pressure to the track member 18.

When the bolt 66 is rotated in the opposite direction, the lugs 56 and 60 are caused to move outward from each other thereby causing the brake pads 58 and 62 to move outward of the track member 18 thereby applying less contact pressure. As such, with the brake system 50, the person may rotate bolt 66 to apply as much or less contact pressure between the brake pads 58 and 62 and the track 18 thereby allowing the person to control the speed at which the track member 12 rotates within the bearings 20. The brake system 50 may further comprise a cleaning pad 72 attached to the brake pads 58 and 62 which acts to clean the track member 18 as it rotates.

Figure 11:
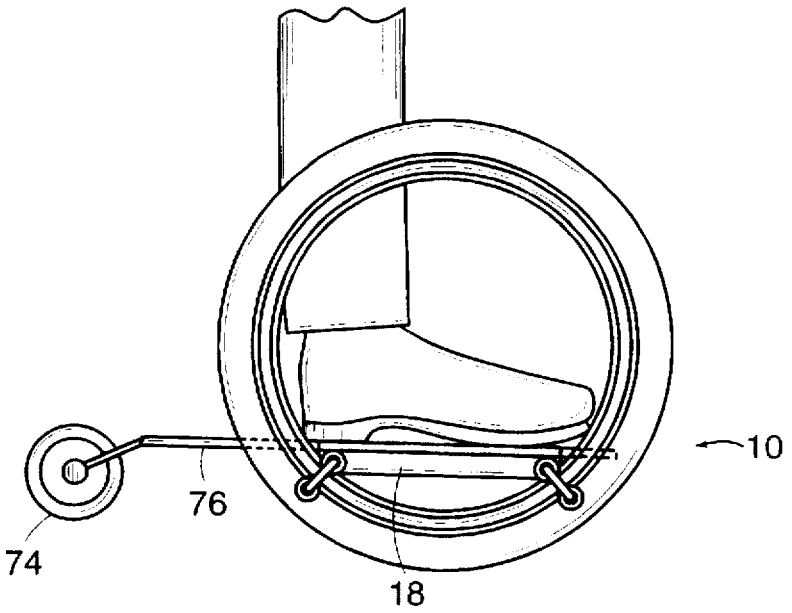
FIG. 11 is a plan view of a second embodiment of the present invention wherein a rear wheel is shown.

Referring to FIG. 11, wherein the device 10 is shown further comprising a rear wheel 74.The rear wheel 74 is positioned rearward or behind the wheel member 12 is may be connected to the foot support plate member 18 by a rod or extension member 76. The rear wheel 74 may be used and is generally adapted to provide stability to the device 10 when used by the person.

The device 10 of the present invention may be used by a person in a variety of ways. By way of example only and as shown in FIG. 1, two devices 10 may be employed wherein each foot 17 of the person is positioned on each device 10 and parallel to the wheel member 12. In this way, the person can use the devices 10 in a fashion similar to skis or in-line skates. By way of further example only, two devices 10 may be employed wherein each foot 17 of the person is positioned on each device 10 and placed inward (or perpendicular) to the wheel member 12. In this configuration, the support member 18 of each device 10 could be connected together by a support member (not shown) and as such, the person could use the devices 10 is a fashion similar to a skate board. By way of further example only, a person could use only a single device 10 wherein both feet 17 of the person are positioned on each device 10 and placed inward (or perpendicular) to the wheel member 12. In this configuration, the person is also using the device 10 in a fashion similar to a skate board.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A recreational device for use by a person to traverse a terrain surface comprising:

(a) a wheel member;

(b) a track member engaged with said wheel member and comprising a first bearing surface and a second bearing surface, said track member is spaced outward, apart from and positioned substantially adjacent to said wheel member, said track member is parallel to said wheel member;

(c) a foot plate member adapted to carry and support the person; and (d) first and second bearing members extending from said foot plate member, said first bearing member being engaged with said first bearing surface of said track member and said second bearing member being engaged with said second bearing surface of said track member, whereby said track member rotates about said foot plate member when said wheel member is rolled upon the terrain surface.

2. The device of claim 1, wherein said track member comprises an upper half portion and a lower half portion.

3. The device of claim 2, wherein said first and second bearing members are positioned within said lower half portion of said track member.

4. The device of claim 3, wherein said first bearing surface is positioned substantially opposite from said second bearing surface.

5. The device of claim 3, wherein said first bearing member is engaged with said first bearing surface in a position substantially opposite to the position of said engagement of said second bearing member with said second bearing surface.

6. The device of claim 5, further comprising a third and fourth bearing member, said third bearing member being engaged with said first bearing surface and said fourth bearing member being engaged with said second bearing surface.

7. The device of claim 6, wherein said third and fourth bearing members are positioned within said lower half portion of said track member.

8. The device of claim 7, wherein said third bearing member is engaged with said first bearing surface in a position substantially opposite to the position of said engagement of said second bearing member with said second bearing surface.

9. The device of claim 8, wherein said first, second, third, and fourth bearing members each comprise at least two separate bearing elements.

10. The device of claim 8, wherein said wheel member comprises a housing and a tire engaged with said housing.

11. The device of claim 10, wherein said track member and said housing of said wheel member are integrally formed.

12. The device of claim 9, wherein said track member is of solid construction.

13. The device of claim 11, wherein said track and said housing of said wheel member are made from a plastic material.

14. The device of claim 13, wherein said housing and said tire are integrally formed.

15. The device of claim 8, wherein said foot plate comprises a support surface and first and second legs.

16. The device of claim 15, wherein said first and second bearing members are mounted to said first leg and said third and fourth bearing members are mounted to said second leg.

17. The device of claim 16, wherein said support surface is substantially planar and is defined by a horizontal plane and said first and second legs are inwardly angled relative to said horizontal plane of said support surface.

* * * * *